US007156020B2

(12) United States Patent
Kochesky

(10) Patent No.: US 7,156,020 B2
(45) Date of Patent: Jan. 2, 2007

(54) COMPOSITE STAMP PAD

(75) Inventor: Frank F. Kochesky, Newburgh, NY (US)

(73) Assignee: American Felt and Filter Company, New Windsor, NY (US)

( * ) Notice: Subject to any disclaimer, the term of this patent is extended or adjusted under 35 U.S.C. 154(b) by 0 days.

(21) Appl. No.: 11/234,773

(22) Filed: Sep. 23, 2005

(65) Prior Publication Data

US 2006/0102028 A1 May 18, 2006

Related U.S. Application Data

(60) Provisional application No. 60/612,425, filed on Sep. 23, 2004.

(51) Int. Cl.
*B41K 1/54* (2006.01)

(52) U.S. Cl. ..... 101/333; 428/296.7; 428/297.1; 118/264

(58) Field of Classification Search ..... 101/327, 101/333, 335; 118/264, 269; 428/296.7, 428/297.1, 292.1
See application file for complete search history.

(56) References Cited

U.S. PATENT DOCUMENTS 5,284,704 A * 2/1994 Kochesky et al. ..... 442/364
6,640,709 B1 * 11/2003 Lowrance ..... 101/333

* cited by examiner

*Primary Examiner*—Leslie J. Evanisko
(74) *Attorney, Agent, or Firm*—Amad Tayebi

(57) ABSTRACT

A composite stamp pad is made of two layers joined together at their interface. The top layer of the composite stamp pad, which contacts the raised points side of the stamp, has a dense and firm fine denier fibrous structure in order to be able to transfer ink to the raised points of the stamp with high precision and without depositing ink into the recessed areas located between the raised points of the stamp. The bottom layer of the composite stamp pad has a lighter and softer coarser denier fibrous structure in order to be able to have a large ink holding capacity. A method of manufacturing the composite stamp pad is described.

1 Claim, 1 Drawing Sheet

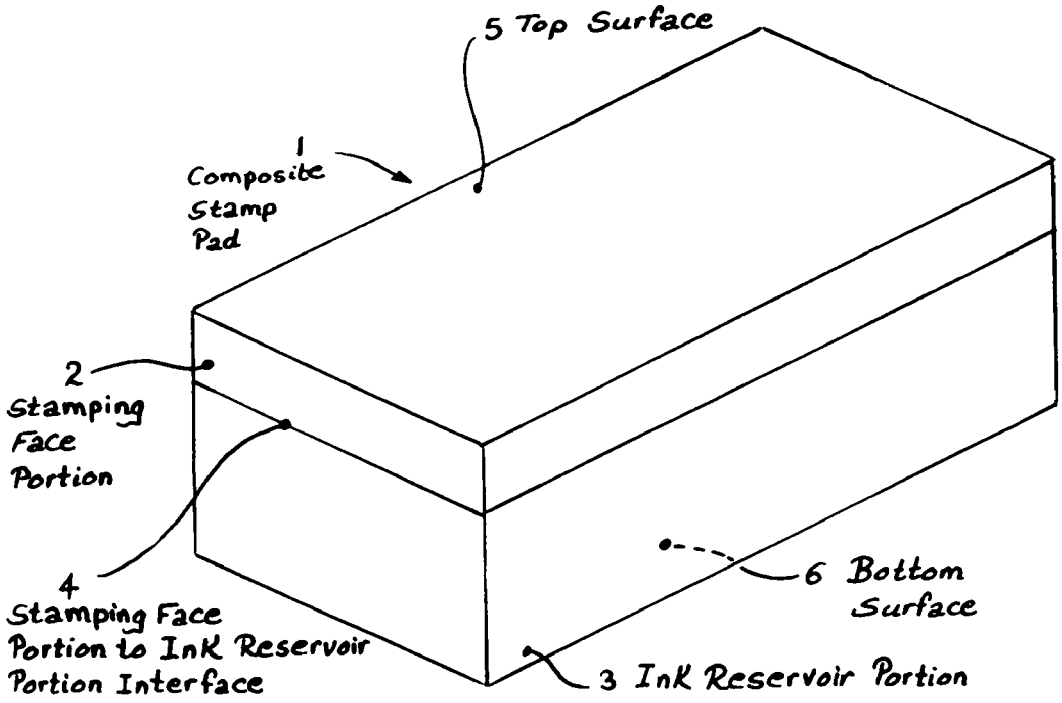
Figure (1)
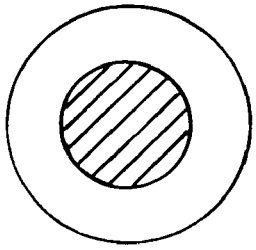
≡ High-Melting Point Component
≡ Low-Melting Point Component
Figure (2)
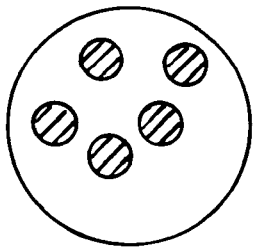
≡ High-Melting Point Component
≡ Low-Melting Point Component
Figure (3)
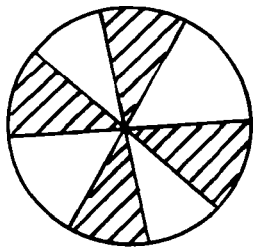
≡ High-Melting Point Component
≡ Low-Melting Point Component
Figure (4)

COMPOSITE STAMP PAD

This application claims priority of Provisional Patent Application No. 60/612,425 filed on Sep. 23, 2004, which is herein incorporated, by reference, in its entirety.

FIELD OF THE INVENTION

The present invention is in the field of stamp pads. In particular, it relates to a porous or permeable structure stamp pad made from a fibrous material and having a composite structure. The top layer of the composite stamp pad, which contacts the raised points side of the stamp, has a dense and firm fine (low) denier fibrous structure in order to be able to transfer ink to the raised points of the stamp with higher precision and without depositing ink into the recessed areas located between the raised points of the stamp. The bottom layer of the composite stamp pad has a lighter (lower density) and softer coarser (higher) denier fibrous structure in order to be able to have a large ink holding capacity, i.e., to act as a high-capacity ink reservoir. The present invention also teaches a method of manufacturing the composite stamp pad.

SUMMARY OF THE INVENTION

In accordance with the present invention a novel stamp pad is provided. The stamp pad is of a composite structure and comprises a stamping face portion and an ink reservoir portion. The stamping face portion comprises a first plurality of fibers. The first plurality of fibers comprises low denier bicomponent fibers, said bicomponent fibers being cohesively bonded together and/or to other fibers which may be contained in said first plurality of fibers at inter-fiber crossover points. A cohesive bond, in accordance with the present invention, is defined as a bond generated by a melting or at least a partial melting action at the contact point between at least two fibers and cosolidification as the temperature of the fibers at the contact point is reduced below the melting point of their surface contact point. The ink reservoir portion comprises a second plurality of fibers, preferably comprising bicomponent fibers, said second plurality of fibers being, on the average, coarser (higher denier) than said bicomponent fibers of said first plurality of fibers by at least 2 denier. The fibers of the second plurality of fibers being bonded together, preferably cohesively at interfiber crossover points. The stamping face portion and the ink reservoir portion being joined together at their interface as a two-layer composite structure, thereby providing a stamp pad with a high-capacity ink reservoir and high precision of ink transfer to the raised points of the stamp.

BACKGROUND OF THE INVENTION

Examination of the prior art yields a variety of designs, compositions and structures of stamp pads. Some are made of felt material and covered with woven fabrics. Others are made of open-cell foams or are made of gel-like materials. Stamp pads of the prior art which utilize fibrous materials suffer from lack of uniform and accurate transfer of ink from the pad to the raised points side of the stamp. This lack of uniformity and accuracy may be attributable to the use of coarse fibers in the stamp pad or due to the coarse structure of the woven fabric covering the stamp pad surface. Coarse fibers, in a low density structure, provide a higher capacity of ink retention between them, i.e., a higher-capacity ink reservoir. Finer fibers, on the other hand, yield better accuracy and uniformity of ink transfer to the raised points of the stamp but suffer from having a reduced ink storage capacity. The present invention overcomes this problem and provides a composite stamp that has high ink retention/storage capacity as well as excellent uniformity and accuracy of ink transfer from the stamping face of the stamp pad to the raised points/surfaces of the stamp.

BRIEF DESCRIPTION OF THE DRAWING

FIG. 1 shows an isometric view of composite stamp pad.

FIG. 2 shows a sheath-core type of bicomponent fibers.

FIG. 3 shows an islands type of bicomponent fibers.

FIG. 4 shows a segmented distribution type of bicomponent fiber.

DETAILED DESCRIPTION OF THE INVENTION

As shown in FIG. 1, the composite stamp pad 1 of the present invention comprises a stamping face portion 2 having a top surface 5, and an ink reservoir portion 3 having a bottom surface 6. Ink reservoir portion and stamping face portion 2 are joined together, cohesively, at their interface 4.

Stamping face portion 2 is made of a porous fibrous structure which is made of a first plurality of fibers, said first plurality of fibers comprising low denier bicomponent fibers having a weight percentage of at least 75% of the total weight of the stamping face portion. The remaining percentage of weight includes other fibers, including regular or standard (single component) fibers or other fiber coatings, colorings and/or surface treatment agents, such as surfactants. In accordance with the present invention, it is preferable that all the fibers contained in the stamping face portion 2 be bicomponent fibers, i.e., the weight percent of the bicomponent fibers is preferably 100%.

The bicomponent fibers of the stamping face portion are preferably of the sheath-core type and having a sheath component melting point lower than that of the core component. For example, such fibers may be 2 denier sheath-core polyester bicomponent staple fibers having a sheath melting point of 230 F. The melting point of the core portion, of the bicomponent fibers of the stamping face portion, is higher than that of the sheath portion by at least 50 F. The bicomponent fibers used in the stamping face portion and/or in the ink reservoir portion of the composite stamp pad may be sheath-core type, island-type or having a radially segmented distribution of the low and high melting point segments, as shown in FIGS. 2, 3 and 4, respectively. Also, a variety of polymeric materials may be used in the low melting point and in the high melting point portions of the bicomponent fibers, including polyethylene, polyester and polypropylene. The polymeric material of the sheath layer may be different from the polymeric material of the core component. In accordance with the present invention, the denier of the fibers of the stamping face portion ranges from 0.5 to 4. Also, in accordance with the present invention, a preferred denier is 2.

Manufacturing the composite stamp pad 1 of the present invention comprises the steps of:

1) providing a first plurality of fibers for preparing the stamping face portion 2 of the composite stamp pad and intimately, i.e., thoroughly and uniformly blending them, said first plurality of fibers comprising bicomponent fibers constituting at least 75% of the total weight of said first plurality of fibers. The remaining portion of weight of said first plurality of fibers may include other fibers, including regular fibers or standard (single component) fibers or other fiber coatings, colorings and/or surface treatment agents such as surfactants. Preferably, however, said first plurality of fibers is 100% bicomponent fibers of the sheath-core type and having a sheath component melting point lower than that of the core component. Preferably, the melting point of the sheath component is around 230 F. Also, the melting point of the core component is at least 50 F higher than the melting point of the sheath portion. Said first plurality of fibers having deniers in the range of 0.5 to 4.0, preferably 2.

2) carding said first plurality of fibers into a uniform first carded web having a basis weight in the range of 9 to 14 ounces per square yard (oz/sq.yd) and preferably 11 to 12 oz/sq.yd.

3) tacking, i.e., lightly needle punching said first carded web in order to enhance its integrity and to be able to handle it without excessive stretching.

4) subjecting the tacked first carded web to a first heating step, preferably in a stress-free condition by placing the tacked first carded web in an oven at a temperature in the range of 280 F to 320 F. This first heating step may be accomplished by placing the web, in a stress-free state, into an oven at a temperature at least 50 F higher than the melting point of the low melting point component but lower than the melting point of the high melting point component of the bicomponent fibers. This first heating step allows the constituent fibers to shrink. A typical shrinkage experienced by the tacked first carded web is about 20% by area. For example, a web of initial basis weight of 11 to 12 oz./sq.yd shrinks to 13.75 to 15 oz./sq.yd.

5) hot pressing said first carded and shrunk web in a heated press at a temperature at least equal to the melting point of the low melting point component but not exceeding the melting point of the high melting point component of the bicomponent fibers. A preferable temperature used for pressing the stamping face portion is 300 F when the melting point of the low melting point component is 230 F. The first carded web is pressed, for a period of about one minute, to the desired thickness, into a compacted porous structure. For the above mentioned example, a thickness of 0.020 inch is a preferred thickness which yields a bulk density of 57.3 to 62.5 lb/cubic foot which is an acceptable stamping face portion density.

6) providing a second plurality of fibers for preparing the ink reservoir portion 3 of the composite stamp pad and intimately, i.e., thoroughly and uniformly blending them, said second plurality of fibers preferably comprising bicomponent fibers constituting at least 25% of the total weight of said second plurality of fibers. The remaining portion of weight of said second plurality of fibers may include other fibers, including regular fibers or standard (single component) fibers or other fiber coatings, colorings and/or surface treatment agents such as surfactants. The bicomponent fibers of the ink reservoir portion may be and preferably are similar to those of the stamping face portion with regard to their geometric cross sectional material distribution, type of polymeric materials used, melting points and difference between the high and low melting points of their components, preferred melting points, etc. The fibers of the ink reservoir portion, however, are coarser than those of the stamping face portion by at least 2 denier. In accordance with the present invention, the fibers of the stamping face portion are preferably 2 denier fibers and the fibers of the ink reservoir portion are preferably 6 denier fibers. The denier of the fibers of the ink reservoir portion is at least 2.5.

7) carding said second plurality of fibers into a uniform second carded web having a basis weight in the range of 18 to 24 ounces per square yard (oz/sq.yd) and preferably 20 to 22 oz/sq.yd.

8) tacking, i.e., lightly needle punching said second carded web in order to enhance its integrity and to be able to handle it without excessive stretching.

9) subjecting the tacked second carded web to a first heating step, preferably in a stress-free condition by placing the tacked second carded web in an oven at a temperature in the range of 280 F to 320 F. This first heating step may be accomplished by placing the web, in a stress-free state, into an oven at a temperature at least 50 F higher than the melting point of the low melting point component but lower than the melting point of the high melting point component of the bicomponent fibers. This first heating step allows the constituent fibers to shrink. A typical shrinkage experienced by the tacked second carded web is about 20% by area. For example, a web of initial basis weight of 20 to 22 oz./sq.yd. shrinks to 25 to 27.5 oz./sq.yd.

10) cohesively joining the stamping face portion and the ink reservoir portion into a composite stamp pad sheet by hot pressing them together. This hot pressing process is accomplished by placing the pressed stamping face portion, in a sheet form, on top of the pres-shrunk ink reservoir portion, also in a sheet form, and placing the assembly in a hot press and compressing them together to a total thickness in the range of 3/16 to 3/8 inch, preferably 1/4 inch. This hot pressing step is carried out at a temperature of 280 F to 320 F, preferably at 300 F for a period of 1 to 3 minutes, preferably 2 minutes.

11) fabricating a composite stamp pad by cutting the composite stamp pad sheet, thus obtained, into the desired shape and dimensions to fit a stamp pad tray, receiver, container or a box.

The invention claimed is:

1. A composite stamp pad comprising;

a stamping face portion and an ink reservoir portion, said stamping face portion comprising a first plurality of fibers, said first plurality of fibers comprising low denier bicomponent fibers, said bicomponent fibers being cohesively bonded together and/or to other fibers, contained in said first plurality of fibers, at inter-fiber crossover points, said ink reservoir portion comprising a second plurality of fibers comprising bicomponent fibers, said second plurality of fibers being, on the average, coarser than said bicomponent fibers of said first plurality of fibers by at least 2 denier, said fibers of the second plurality of fibers being bonded together cohesively at interfiber crossover points, said stamping face portion and said ink reservoir portion being joined together at their interface as a two-layer composite structure, thereby providing a stamp pad with a high-capacity ink reservoir and high precision of ink transfer to raised points of a stamp.

* * * * *